US006814820B2

(12) United States Patent
Ozbaysal

(10) Patent No.: US 6,814,820 B2
(45) Date of Patent: Nov. 9, 2004

(54) HEAT TREATMENT OF TITANIUM-ALLOY ARTICLE HAVING MARTENSITIC STRUCTURE

(75) Inventor: Kazim Ozbaysal, Blue Ash, OH (US)

(73) Assignee: General Electric Company, Schenectady, NY (US)

( * ) Notice: Subject to any disclaimer, the term of this patent is extended or adjusted under 35 U.S.C. 154(b) by 21 days.

(21) Appl. No.: 09/900,411

(22) Filed: Jul. 6, 2001

(65) Prior Publication Data

US 2003/0005987 A1 Jan. 9, 2003

(51) Int. Cl.[7] ..... C22F 1/18
(52) U.S. Cl. ..... 148/671; 420/419
(58) Field of Search ..... 148/671

(56) References Cited

U.S. PATENT DOCUMENTS

| | | | | |
|---|---|---|---|---|
| 3,901,743 A | | 8/1975 | Sprague et al. | |
| 4,053,330 A | | 10/1977 | Henricks et al. | |
| 4,512,826 A | * | 4/1985 | Whang | 148/407 |
| 4,576,660 A | | 3/1986 | Rowe | 148/407 |
| 4,578,129 A | | 3/1986 | Rowe | 148/407 |
| 4,631,092 A | * | 12/1986 | Ruckle et al. | 148/421 |

FOREIGN PATENT DOCUMENTS

| | | |
|---|---|---|
| EP | 0 921 207 A1 | 6/1999 |
| EP | 1 078 997 A1 | 2/2001 |
| JP | 61-106758 | 5/1986 |
| JP | 63-223155 | 3/1987 |

OTHER PUBLICATIONS

ASM Handbook, 10th Edition, vol. 2, "Wrought Titanium and Titanium Alloys: Titanium Alloys", ASM International, 1992.*

ASM Handbook, 10th Edition, vol. 2, "Wrought Titanium and Titanium Aloys: Wrought Alloy Processing", ASM International, 1992.*

ASM Handbook, 10th Edition, vol. 2, "Wrought Titanium and Titanium Alloys: Properties", ASM International, 1992.*

ASM Handbook, 10th Edition, vol. 2, "Titanium and Titanium Alloy Castings: Weld Repair", ASM International, 1992.*

ASM Handbook, vol. 4, "Heat Treating of Titanium and Titanium Alloys: Solution Treating and Aging", ASM International, 1991.*

ASM Handbook, 10th Ed., vol. 2, Section on Titanium alloys, 1992.*

Rodney Boyer et al., Materials Properties Handbook: Titanium Alloys, 1994, ASM International, pp. 695, 699, 700.

ASM Handbook, vol. 4, Heat Treating, pp. 915–916, 1991.

* cited by examiner

*Primary Examiner*—George Wyszomierski
(74) *Attorney, Agent, or Firm*—Gregory O. Garmong; Carmen Santa Maria; McNees Wallace & Nurick LLC

(57) ABSTRACT

An article is formed of an alpha-beta titanium-base alloy, preferably an alloy having more than about 3.5 weight percent molybdenum. An example of such an article is a gas turbine compressor blade having a nominal composition, in weight percent, of about 4 percent aluminum, about 4 percent molybdenum, about 2 percent tin, about 0.5 percent silicon, balance titanium and impurities. The article is processed to form a martensitic structure therein. The processing, which typically involves forging or weld repairing, includes the steps of first heating the article to a first-heating temperature of greater than about 1600° F., and thereafter first cooling the article to a temperature of less than about 800° F. The article is thereafter second heated to a second-heating temperature of from about 1275° F. to about 1375° F. for a time of from about 1 to about 7 hours, and thereafter second cooled to a temperature of less than about 800° F. at a second cooling rate that does not exceed about 15° F. per second.

21 Claims, 3 Drawing Sheets

HEAT TREATMENT OF TITANIUM-ALLOY ARTICLE HAVING MARTENSITIC STRUCTURE

This invention relates to the heat treatment of a titanium-alloy article and, more particularly, to the annealing heat treatment of the titanium-alloy article that forms a martensitic structure during prior processing steps.

BACKGROUND OF THE INVENTION

The fabrication of a metallic article which has a range of section thicknesses and is made of an alloy whose properties depend upon cooling rate presents a manufacturing challenge. The thinner portions of the article cool faster than the thicker portions, so that the thinner portions have one set of properties and the thicker portions have another set of properties. It some cases it may be possible to use compensating cooling rates for the various portions or very slow cooling rates, but this adds considerable expense and is not always practical.

An example is the manufacture of a forged compressor blade for a gas turbine engine. The compressor blades may be made of a titanium alpha-beta alloy such as Ti-442, having a nominal composition, in weight percent, of about 4 percent aluminum, about 4 percent molybdenum, about 2 percent tin, about 0.5 percent silicon, balance titanium. This alloy forms a martensitic structure upon cooling, and the nature and extent of the martensite transformation depend upon the cooling rate. The material is heated to about 1650° F., transferred to the forging dies, and forged at the starting temperature of about 1650° F. The article cools in contact with the cooler forging dies. The thin airfoil portions of the compressor blade, and particularly the leading and trailing edges, cool rapidly and develop extensive martensite, while the thick dovetail portions cool more slowly and form little if any martensite. The martensite in the airfoil portion is relatively brittle and susceptible to impact damage and premature failure. Similar problems arise during the weld repair of articles made of these alloys that have been in service.

To overcome these problems and provide the desired combination of properties, various heat treatments have been developed and employed. In one, the hot-forged article is heat treated at 1650° F. for one hour and slow cooled, followed by a low-temperature aging at 932° F. for 24 hours. In another heat treatment, the hot-forged article is heat treated at 1020° F. for 4 hours. Neither of these heat treatments has proved successful in imparting the required combination of a high-strength, fatigue-resistant dovetail and a more-ductile, damage-resistant finished airfoil that does not distort during processing.

Accordingly, there is a need for a heat treatment for hot-forged Ti-442 articles, and, more generally, for articles made of titanium-base alloys that form martensite or other cooling-rate-related microstructures upon cooling. The present invention fulfills this need, and further provides related advantages.

BRIEF SUMMARY OF THE INVENTION

The present invention provides a heat treatment technique that is useful for heat treating alpha-beta titanium-base alloys, such as those with a relatively high molybdenum content, that form a martensitic structure upon rapid cooling. It is particularly useful in conjunction with Ti-442 alloy. The heat treatment procedure produces high strength and fatigue resistance in the thicker portions of the article (e.g., the dovetail in the preferred compressor blade application), and improved ductility, damage tolerance, fracture toughness, and ballistic-impact resistance in the thinner portions of the article (e.g., the airfoil and particularly the leading and trailing edges of the compressor blade). The thinner portions do not substantially distort during the heat treatment, so that rework of the article is minimized or avoided.

A method for heat treating an article comprises the steps of providing an article formed of a alpha-beta titanium-base alloy, and processing the article to form a martensitic structure therein. The step of processing includes the steps of first heating the article to a first-heating temperature of greater than about 1600° F., and thereafter first cooling the article to a temperature of less than about 800° F. The method further includes thereafter second heating the article to a second-heating temperature of from about 1275° F. to about 1375° F. for a time of from about 1 to about 7 hours (most preferably from about 4 to about 6 hours), and thereafter second cooling the article to a temperature of less than about 800° F. at a second cooling rate that does not exceed about 15° F. per second (and is usually from about 1° F. per second to about 15° F. per second). The second heating to the second-heating temperature is preferably to a temperature of about 1350° F. for a time of about 6 hours. The second cooling is optionally followed by a step of stress relieving the article at a temperature of from about 1000° F. to about 1050° F., most preferably 1020° F.+/−20° F. for two hours.

The titanium-base alloy typically contains molybdenum in an amount exceeding about 3.5 percent by weight. In a preferred application, the titanium-base alloy is Ti-442 which has a nominal composition, in weight percent, of about 4 percent aluminum, about 4 percent molybdenum, about 2 percent tin, about 0.5 percent silicon, balance titanium. The total of all of the elements, including impurities and minor elements, is 100 percent by weight.

The present approach is most advantageously applied for articles that have thin portions and thick portions. For example, the article may have have a first portion with a thickness of less than about 0.2 inch and a second portion with a thickness of greater than about 0.2 inch. A gas turbine compressor blade is such an article, having a thin airfoil portion and a thick dovetail portion.

The processing that produces the martensitic structure involves heating to the first-heating temperature of greater than about 1600° F. The processing may be a simple heat treatment, but it usually involves other operations as well. For example, in a new compressor blade the step of processing may include forging the article at the first-heating temperature, such as forging at a starting temperature of about 1650° F. In a compressor blade that has previously seen service and has experienced removal of the blade tip or other damage to the airfoil portion, the step of processing may include weld repairing the article at the first-heating temperature, which is well in excess of 1600° F. and up to the melting point of the alloy.

This family of alloys has not had a generally accepted annealing procedure in the past, and it was not recommended for use in the annealed condition. The present approach is based upon a recognition that the prior heat treatments used for these alloys have been developed primarily from experience with relatively thick pieces of material that do not have thin portions and thick portions. The prior approaches did not produce the desired combination of properties in the article with thin portions and thick portions. The prior heat treatment at 1650° F. for one hour and slow cool, followed by a low-temperature aging at 932° F. for 24 hours produced high distortion of the thin portions. The prior heat treatment at 1020° F. for 4 hours produced the article with minimal distortion of the thin portion and a high-strength, fatigue-resistant dovetail, but the airfoil had too high a strength and insufficient damage tolerance and ballistic impact resistance. The present approach including the second heating, which serves as an annealing treatment, imparts improved properties to the finished article. Good damage tolerance and ballistic impact resistance is a necessary property of the compressor blade airfoils, because of the possibility of ingestion of foreign objects into the front end and compressor stages of the engine.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
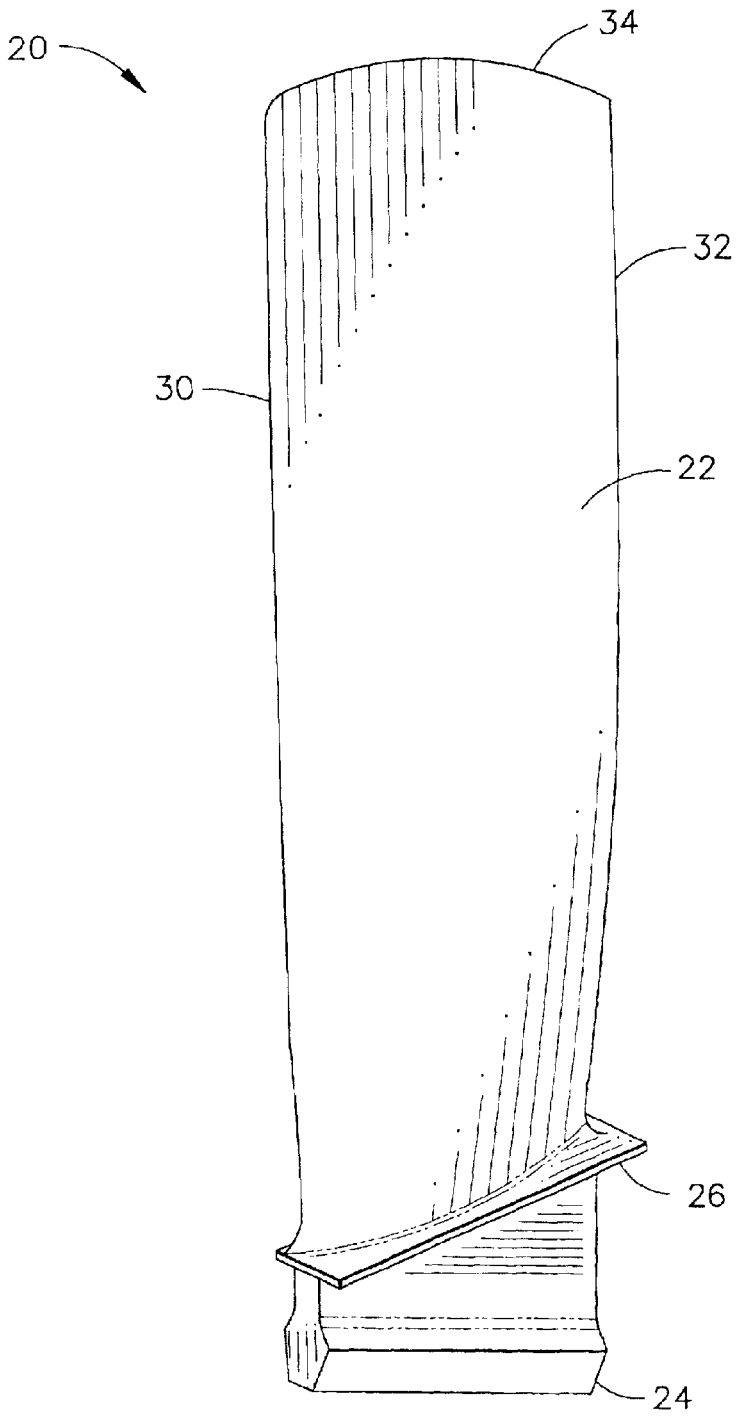
FIG. 1 is a perspective view of a gas turbine compressor blade.

FIG. 1 depicts a component article of a gas turbine engine such as a compressor blade 20. The compressor blade 20 is formed of a titanium-base alloy as will be discussed in greater detail. The compressor blade 20 includes an airfoil 22 that acts against the incoming flow of air into the gas turbine engine and axially compresses the air flow. The compressor blade 20 is mounted to a compressor disk (not shown) by a dovetail 24 which extends downwardly from the airfoil 22 and engages a slot on the compressor disk. A platform 26 extends longitudinally outwardly from the area where the airfoil 22 is joined to the dovetail 24. The airfoil 22 has a leading edge 30, a trailing edge 32, and a tip 34 remote from the platform 26.

The airfoil 22 is relatively thin measured in a transverse direction (i.e., perpendicular to a chord to the convex side drawn parallel to the platform), with at least some portions that are no greater than about 0.2 inch thick. The dovetail 24 is relatively thick measured perpendicular to its direction of elongation, being greater than about 0.2 inch thick in its thickest portion. As an example, the airfoil 22 of the depicted blade is typically about 0.190–0.200 inch thick in its thickest portion, and the dovetail 24 is typically about 0.750 inch thick in its thickest portion, although these thicknesses vary for different gas turbine engines. Meeting property requirements is most challenging at the leading and trailing edges of the airfoil 22, where the thickness is about 0.025 inch or less. Because of this large difference in thicknesses of the portions and the nature of the titanium-base alloy, the control of the properties in the two portions is difficult and has led to the present invention.

Figure 2:
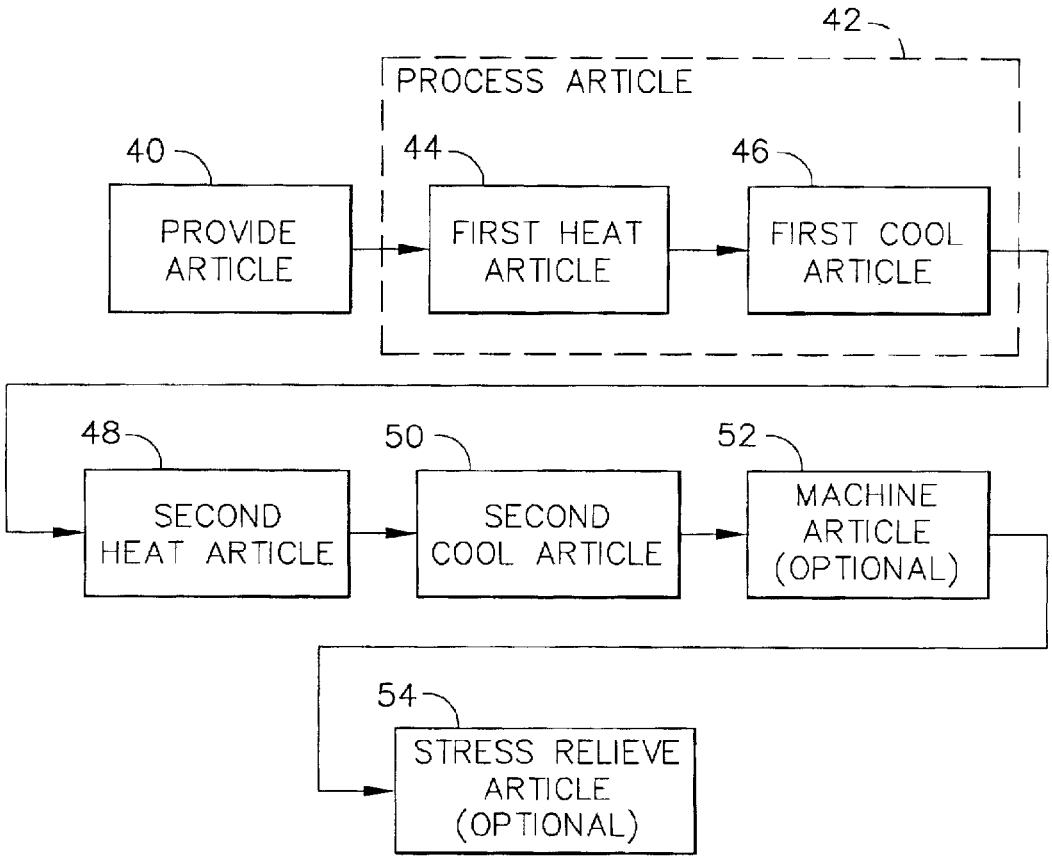
FIG. 2 is a block flow diagram of an approach for practicing the invention.
Figure 3:
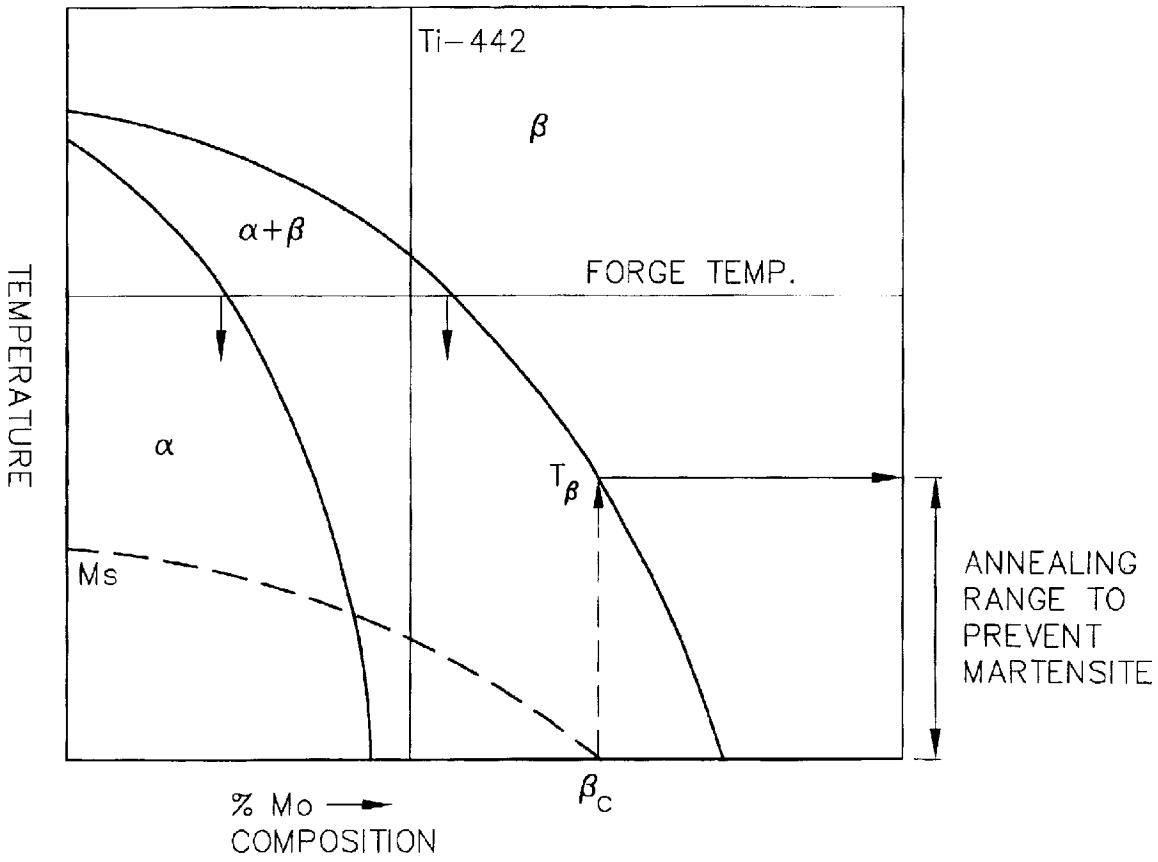
FIG. 3 is a schematic pseudo-binary temperature-composition phase diagram of an alpha-beta titanium-base alloy.

FIG. 2 depicts an approach for practicing the present invention. An article such as the compressor blade 20 is provided, numeral 40. The article is made of a titanium-base alloy, which is an alloy having more titanium than any other element. The titanium-base alloy is desirably an alpha-beta titanium alloy, most preferably with more than about 3.5 weight percent molybdenum, that forms a martensitic structure when cooled at a sufficiently high rate. FIG. 3 is a schematic pseudo-binary (titanium-molybdenum) temperature-composition phase diagram, not drawn to scale, for such a titanium-base alloy. An $\alpha$-$\beta$ (alpha-beta) titanium alloy predominantly forms two phases, $\alpha$ phase and $\beta$ phase upon heat treatment. In titanium alloys, $\alpha$ (alpha) phase is a hexagonal close packed (HCP) phase thermodynamically stable at lower temperatures, $\beta$ (beta) phase is a body centered cubic (BCC) phase thermodynamically stable at higher temperatures, and a mixture of $\alpha$ and $\beta$ phases is thermodynamically stable at intermediate temperatures. Molybdenum is the preferred beta-stabilizing element, and the titanium-base alloy desirably contains an amount of molybdenum exceeding about 3.5 percent by weight of the titanium-base alloy. A preferred $\alpha$-$\beta$ titanium-base alloy is known as Ti-442, having a nominal composition, in weight percent, of about 4 percent aluminum, about 4 percent molybdenum, about 2 percent tin, about 0.5 percent silicon, balance titanium. The total of all of the elements, including impurities and minor elements, is 100 percent by weight.

The article is processed, numeral 42, with the result that it forms a martensitic structure in at least a portion of the article due to the properties of the alloy and the dimensions of the article. The processing 42 includes the steps of first heating the article to a first-heating temperature of greater than about 1600° F., numeral 44, and thereafter first cooling the article to a temperature of less than about 800° F., numeral 46. The step of first heating 44 may be simply a heat treatment, but more typically it includes a further processing operation as well. For example, the step of first heating 44 of the compressor blade 20 during initial manufacturing may include forging of the compressor blade 20 starting at the first-heating temperature of about 1650° F. FIG. 3 illustrates the forging of Ti-442 alloy in the $\alpha+\beta$ region of the phase diagram, by way of example. In another example, the step of first heating 44 of the compressor blade 20 that has previously been in service may include a weld repair of the tip 34, the leading edge 30, the trailing edge 32, and/or the lateral surfaces of the airfoil 22 at the first-heating temperature of greater than about 1600° F. and up to the melting point of the alloy. Each of these operations is within the scope of the invention and involves heating of the compressor blade to the first-heating temperature of greater than about 1600° F., and other processing as well. The cooling rate during the step of first cooling 46 is typically relatively rapid, but is faster in the thinner airfoil 22 and its thinnest portions 30 and 32, than in the thicker dovetail 24. The cooling rate is fastest at the leading edge 30 and trailing edge 32 of the airfoil 22, which are on the order of 1/10 the thickness of the thickest portion of the airfoil and 1/40 the thickness of the dovetail. The relative fast cooling of the airfoil 22 produces a martensitic microstructure in the airfoil 22 and particularly near the leading edge 30 and the trailing edge 32, although there is much less or no martensitic microstructure in the dovetail 24. Thus, the article at this point has a variety of microstructures, martensitic in the thinner portions and non-martensitic in the thicker portions. The subsequent processing must, however, produce acceptable properties throughout the article.

To achieve the desired properties, the article is thereafter second heated to a second-heating temperature of from about 1275° F. to about 1375° F. for a time of from about 1 to about 7 hours, most preferably from about 4 to about 6 hours, numeral 48. The second-heating is preferably at the second-heating temperature of about 1350° F. for about 4 hours minimum, and desirably about 6 hours. These temperatures and times are not arbitrary, but are selected responsive to the formation thermodynamics and kinetics of the martensite. As shown schematically in FIG. 3, martensite is formed only below a martensite start temperature $M_s$ that is characteristic of each composition. The annealing must be conducted above the $M_s$ value associated with a critical beta phase composition for the beta phase, $\beta_c$. $\beta_c$ is determined by semi-quantitative EDS (energy dispersive spectrometry) procedures to be about 10 percent molybdenum. The annealing must be conducted below the temperature $T_\beta$ of the $\alpha+\beta/\beta$ transus line for the composition $\beta_c$, or the composition of the beta phase may result in the formation of martensite upon cooling. The β phase must reach this percentage (or higher) of molybdenum in order not to form martensite during cooling and to successfully decompose martensite during the heat treatment. The $\beta_c$ value is about 10 percent molybdenum in the β phase, to approximately double the fracture toughness. Molybdenum contents below about 10 percent in the β phase result in low fracture toughness in the airfoil. If the temperature is below the minimum indicated range, martensite may form upon cooling because the temperature is below the $M_s$ line. The maximum and minimum annealing temperatures may not be exceeded, or the annealing will not be successful. That is, the second heating 48 may not be below the minimum annealing temperature or above the maximum annealing temperature.

For Ti-442 and similar titanium-base alloys, the annealing range according to the present approach is from about 1275° F. to about 1375° F. The most preferred annealing temperature of 1350° F. is selected to be near the top of the range for good kinetics, but sufficiently below the maximum temperature of the range to ensure that the maximum temperature is not exceeded. The permitted annealing time allows the annealing to proceed to completion at these temperatures. The annealing time of from about 4 to about 6 hours within this temperature range has been found to produce the optimal properties, although improvements are obtained over prior approaches at shorter anneal times of from about 1 to about 4 hours. As the anneal time is reduced, the fatigue properties are improved but the fracture toughness decreases. As the anneal time is increased, the fatigue properties decrease but the fracture toughness improves. The selected preferred annealing time of from about 4 to about 6 hours, and most preferably 6 hours, results in the optimal combination of properties.

During the second heating step 48, the article is preferably wrapped in commercially pure titanium foil or tantalum foil. The foil overwrap suppresses formation a case of alpha phase at the surface of the article, so that the thickness of any alpha phase layer at the surface is desirably 0.00005 inches or less. An excessively thick alpha-case, if present at the surface of the article, reduces the fatigue performance of the article by serving as a site for the premature initiation of fatigue cracks. The use of the foil overwrap is preferred for both new parts and repair of parts previously in service.

The article is thereafter second cooled to a temperature of less than about 800° F. at a second cooling rate that does not exceed about 15° F. per second, numeral 50, and is preferably in the range of from about 1° F. per second to about 15° F. per second. When the temperature of the article falls below about 800° F., it may be cooled the rest of the way to room temperature by gas or fan cooling. The relatively slow cooling from the second-heating temperature to a temperature of less than about 800° F. ensures that the martensitic structure will not reform to reduce the impact resistance and damage tolerance of the airfoil 22. The slow cooling also avoids or minimizes distortion of the airfoil due to differential thermal strains, thereby avoiding or minimizing rework of the heat-treated article.

The article may thereafter optionally be machined as necessary, numeral 52. Where the article is machined, it may thereafter optionally be stress relieved, numeral 54, by heating the article to a temperature of from about 1000° F. to about 1050° F., preferably about 1020° F., for a time of up to 2 hours.

The heat treatment procedure produces high strength and fatigue resistance in the thicker portions of the article (i.e., the dovetail 24), and improved ductility, damage tolerance, and ballistic-impact resistance in the thinner portions of the article (i.e., the airfoil 22 and particularly at the leading edge 30 and the trailing edge 32) by decomposing the martensite into a strengthened precipitation-hardened structure. The thinner portions do not substantially distort during the heat treatment, so that rework of the article is minimized.

The invention has been reduced to practice using the approach of FIG. 2 in conjunction with hot forging of the compressor blade 20 during step 44. The mechanical properties of the finished compressor blade 20 were measured and compared with the properties obtained with conventional processing. Conventional processing produces a fracture toughness of 22 ksi $(in)^{1/2}$, which the present processing with an anneal second heating of 1350° F. for 6 hours produces a fracture toughness of abut 45.2 ksi $(in)^{1/2}$.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for heat treating an article, comprising the steps of:

providing an article having a nominal composition, in weight percent, of about 4 percent aluminum, about 4 percent molybdenum, about 2 percent tin, about 0.5 percent silicon, balance titanium and impurities;

processing the article to form a martensitic structure therein, the step of processing including the steps of first heating the article to a first-heating temperature of greater than about 1600° F. and in the alpha-plus-beta region of a phase diagram of the article, and thereafter first cooling the article to a temperature of less than about 800° F.; thereafter second heating the article to a second-heating temperature of from about 1275° F. to about 1375° F. for a time of from about 1 to about 7 hours; and thereafter second cooling the article to a temperature of less than about 800° F. at a second cooling rate that does not exceed about 15° F. per second.

2. The method of claim 1, wherein the step of providing the article includes the step of providing the article having a first portion with a thickness of less than 0.2 inch and a second portion with a thickness of greater than 0.2 inch.

3. The method of claim 1, wherein the step of providing the article includes the step of providing a gas turbine compressor blade.

4. The method of claim 1, wherein the step of processing includes the step of forging the article at the first-heating temperature.

5. The method of claim 1, wherein the step of processing includes the step of forging the article at a temperature of about 1650° F.

6. The method of claim 1, wherein the step of second heating includes the step of second heating to the second-heating temperature of about 1350° F. for a time of from about 4 to about 6 hours.

7. The method of claim 1, wherein the step of second cooling includes the step of second cooling the article at the second cooling rate of from about 1° F. per second to about 15° F. per second.

8. The method of claim 1, including an additional step, after the step of second cooling, of stress relieving the article at a temperature of from about 1000° F. to about 1050° F.

9. The method of claim 1, wherein the step of second heating includes a time of from about 4 to about 6 hours at the second-heating temperature.

10. The method of claim 1, wherein the step of second heating includes the step of wrapping the article in a foil selected from the group consisting of commercially pure titanium foil and tantalum foil.

11. The method of claim 1, wherein the step of processing includes the step of weld repairing the article at the first-heating temperature.

12. A method for heat treating an article, comprising the steps of:

providing an article formed of an alpha-beta titanium-base alloy;

processing the article to form a martensitic structure therein, the step of processing including the steps of first heating the article to a first-heating temperature of greater than about 1600° F. and in the alpha-plus-beta region of a phase diagram of the article, and thereafter first cooling the article to a temperature of less than about 800° F.; thereafter second heating the article to a second-heating temperature of from about 1275° F. to about 1375° F. for a time of from about 1 to about 7 hours; and thereafter second cooling the article to a temperature of less than about 800° F. at a second cooling rate that does not exceed about 15° F. per second.

13. The method of claim 12, wherein the step of providing the article includes the step of providing the article formed of the alpha-beta titanium-base alloy having more than about 3.5 weight percent molybdenum.

14. The method of claim 12, wherein the step of providing the article includes the step of providing the article having a first portion with a thickness of less than 0.2 inch and a second portion with a thickness of greater than 0.2 inch.

15. The method of claim 12, wherein the step of providing an article includes the step of providing a gas turbine compressor blade.

16. The method of claim 12, wherein the step of processing includes the step of forging the article at the first-heating temperature.

17. The method of claim 12, wherein the step of second heating includes the step of second heating to the second-heating temperature of about 1350° F. for a time of from about 4 to about 6 hours.

18. The method of claim 12, including an additional step, after the step of second cooling, of stress relieving the article at a temperature of from about 1000° F. to about 1050° F.

19. The method of claim 12, wherein the step of second heating includes a time of from about 4 to about 6 hours at the second-heating temperature.

20. The method of claim 12, wherein the step of second heating includes the step of wrapping the article in a foil selected from the group consisting of commercially pure titanium foil and tantalum foil.

21. The method of claim 12, wherein the step of processing includes the step of weld repairing the article at the first-heating temperature.

* * * * *